US011788557B1

(12) United States Patent
Swiatek et al.

(10) Patent No.: US 11,788,557 B1
(45) Date of Patent: Oct. 17, 2023

(54) CENTRIFUGAL ACCELERATION STABILIZER

(71) Applicant: Ingersoll-Rand Industrial U.S., Inc., Davidson, NC (US)

(72) Inventors: Chester V. Swiatek, Amherst, NY (US); Mikhail Grigoriev, East Amherst, NY (US); Paul C. Brown, Buffalo, NY (US); Charles Impastato, East Aurora, NY (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 0 days.

(21) Appl. No.: 17/738,730

(22) Filed: May 6, 2022

(51) Int. Cl.

| | |
|---|---|
| ***F04D 29/44*** | (2006.01) |
| ***F04D 29/66*** | (2006.01) |
| ***F04D 17/10*** | (2006.01) |
| *F04D 29/46* | (2006.01) |

(52) U.S. Cl.
CPC ..... *F04D 29/661* (2013.01); *F04D 17/10* (2013.01); *F04D 29/441* (2013.01); *F04D 29/444* (2013.01); *F04D 29/464* (2013.01)

(58) Field of Classification Search
CPC ..... F04D 29/444; F04D 29/441; F04D 29/44; F04D 29/464
See application file for complete search history.

(56) References Cited

U.S. PATENT DOCUMENTS

| | | | | | |
|---|---|---|---|---|---|
| 2,898,031 | A * | 8/1959 | Voigt | F04D 29/441 | 415/181 |
| 3,263,424 | A * | 8/1966 | Birmann | F01D 25/145 | 285/330 |
| 3,289,921 | A * | 12/1966 | Soo | F04D 29/681 | 415/207 |
| 4,527,949 | A * | 7/1985 | Kirtland | F04D 29/462 | 415/150 |
| 4,900,225 | A | 2/1990 | Wulf et al. | | |
| 4,902,200 | A * | 2/1990 | Bandukwalla | F04D 29/464 | 415/157 |
| 8,157,516 | B2 * | 4/2012 | Chen | F04D 29/441 | 415/173.1 |
| 8,328,535 | B2 * | 12/2012 | Anschel | F01D 17/165 | 415/208.4 |

(Continued)

*Primary Examiner* — Woody A Lee, Jr.
*Assistant Examiner* — Behnoush Haghighian
(74) *Attorney, Agent, or Firm* — Kevin E. West; Advent, LLP

(57) ABSTRACT

A dynamic compressor includes an impeller having impeller vanes disposed around a hub, a shroud, and a diffuser having a shroud surface adjacent to the shroud and a hub surface adjacent to the hub, wherein the diffuser is circumferentially disposed around the impeller. The diffuser includes a plurality of diffuser vanes extending from the hub surface to the shroud surface, each having a vane leading edge and a vane trailing edge. The diffuser includes a centrifugal acceleration stabilizer ring formed in the shroud surface located in a vaneless region defined between an impeller trailing edge and the vane leading edge. The centrifugal acceleration stabilizer ring stabilizes the flow of the fluid by changing the circumferentially-flowing high velocity fluid flow exiting the impeller into a radially-flowing high velocity fluid flow before entering the diffuser, improving the efficiency of the dynamic compressor.

17 Claims, 17 Drawing Sheets

(56) References Cited

U.S. PATENT DOCUMENTS

| | | | | |
|---|---|---|---|---|
| 9,874,224 | B2 * | 1/2018 | Morita | F02B 33/40 |
| 9,874,226 | B2 * | 1/2018 | Fukuyama | F04D 27/0253 |
| 9,970,455 | B2 * | 5/2018 | Cho | F04D 29/441 |
| 10,066,638 | B2 * | 9/2018 | Bessho | F04D 17/10 |
| 10,066,639 | B2 * | 9/2018 | Annati | F04D 29/444 |
| 11,209,015 | B2 * | 12/2021 | Ueno | F04D 29/422 |
| 11,408,439 | B2 * | 8/2022 | Higashimori | F04D 29/441 |
| 2009/0060731 | A1 * | 3/2009 | Chen | F04D 29/441 415/204 |
| 2016/0084263 | A1 * | 3/2016 | Morita | F04D 29/422 415/204 |
| 2016/0265549 | A1 * | 9/2016 | Annati | F04D 29/441 |
| 2016/0265550 | A1 * | 9/2016 | Annati | F04D 29/624 |
| 2016/0281727 | A1 * | 9/2016 | Lardy | F04D 13/06 |
| 2020/0063753 | A1 * | 2/2020 | Higashimori | F04D 29/441 |

* cited by examiner

CENTRIFUGAL ACCELERATION STABILIZER

BACKGROUND

Dynamic compressors are employed to provide a pressurized flow of fluid for various applications. Dynamic compressors such as centrifugal compressors increase the pressure of a continuous flow of fluid by adding energy to the flow of fluid through the rotation of an impeller.

DRAWINGS

The Detailed Description is described with reference to the accompanying figures. The use of the same reference numbers in different instances in the description and the figures may indicate similar or identical items.

DETAILED DESCRIPTION

Figure 1:
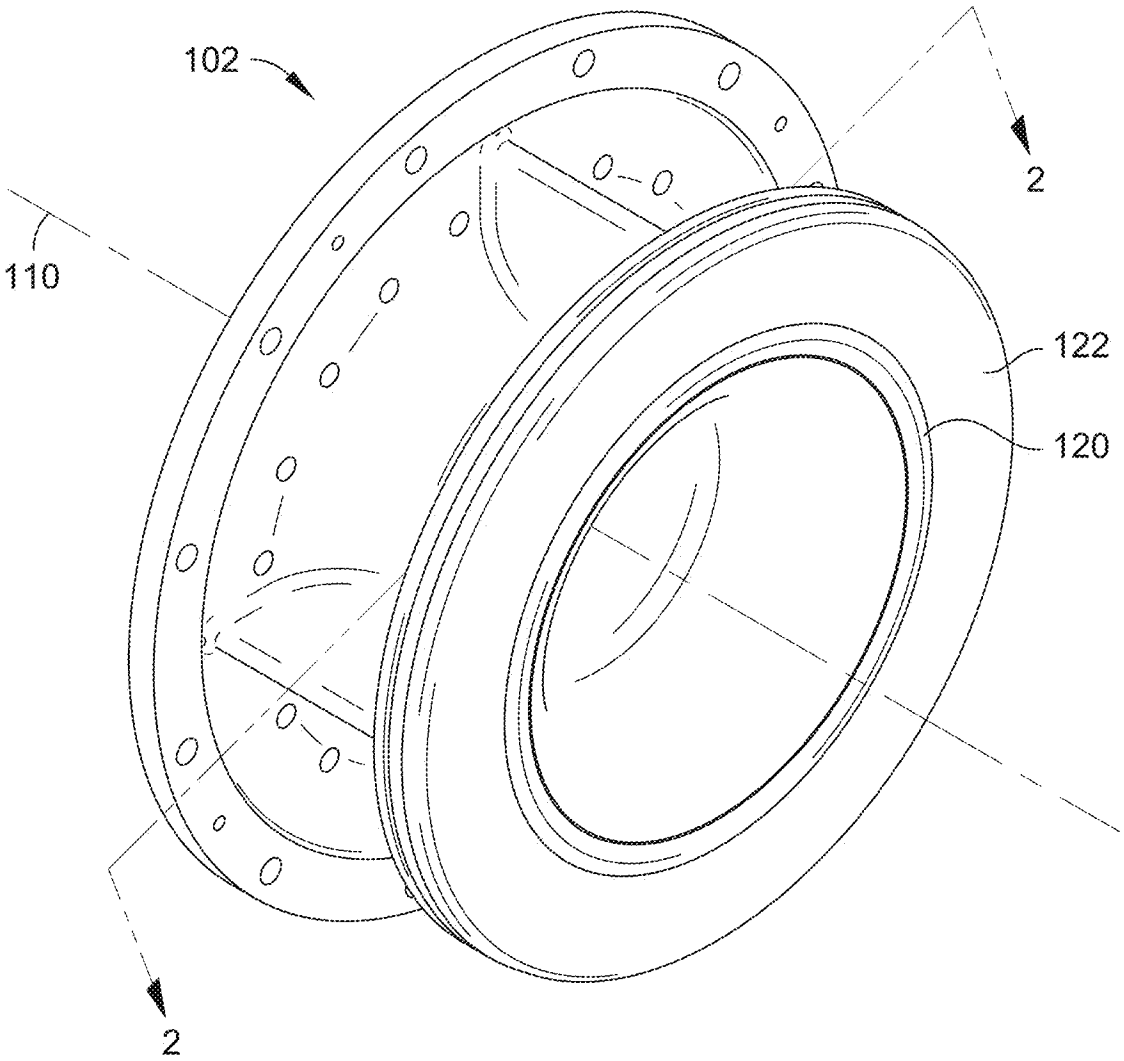
FIG. 1 is an isometric view illustrating a shroud of a centrifugal compressor having a centrifugal acceleration stabilizer in accordance with example embodiments of the present disclosure.

For the purposes of promoting an understanding of the principles of the subject matter, reference will now be made to the embodiments illustrated in the drawings and specific language will be used to describe the same. It will nevertheless be understood that no limitation of the scope of the subject matter is thereby intended. Any alterations and further modifications in the described embodiments, and any further applications of the principles of the subject matter as described herein are contemplated as would normally occur to one skilled in the art to which the subject matter relates.

Overview

Dynamic fluid machines or turbomachines are mechanical devices that extract energy from a fluid and/or increase the kinetic energy of a fluid. Turbomachines include turbines, pumps, and dynamic compressors, such as axial compressors and centrifugal or radial compressors. Dynamic compressors are rotary continuous-flow machines that accelerate air or gas using a rapidly rotating element. A dynamic compressor uses dynamic displacement compression to compress fluid, such as gas (e.g., air). For example, a dynamic compressor can be configured as a centrifugal compressor, which uses an impeller that draws gas between impeller blades disposed around a hub to accelerate the gas to a high velocity. A shroud surrounding the impeller directs the gas exiting the impeller. The gas is then discharged through a diffuser via a diffuser passage formed between a hub surface and a shroud surface. In the diffuser, the kinetic energy of the flow is reduced, increasing the static pressure of the gas.

Fluid flow is three-dimensional in nature, this means that fluid flow parameters such as velocity and pressure are functions of all three coordinate directions. In three-dimensional flow field applications, flow fields are divided between a primary flow or core flow and a secondary flow. The primary flow flows parallel to (e.g., in the same direction as) the main direction of the fluid motion, whereas the secondary flow flows perpendicular to the main direction of the fluid motion. In many impeller designs (especially high flow factor impellers), a zone of secondary flow is developed in the diffuser passage at the discharge of the impeller and proximate to the shroud side of the diffuser inlet. Given the significant momentum difference between the primary and secondary flow, there is a dramatic change in gas flow angles between the hub surface (core flow dominated) and the shroud surface (secondary flow dominated). This zone of secondary flow varies in shape and magnitude depending on the design of the impeller, varying between ten percent (10%) and thirty percent (30%) of the volume of the diffuser passage, and causes a significant loss in efficiency in overall compressor stage performance.

To overcome this loss in efficiency, certain centrifugal compressor designs pinch the diffuser passage coming out of the impeller. For example, the cross-sectional area of the diffuser passage formed between the shroud surface and the hub surface is gradually reduced until a minimum throat value is reached. However, by reducing the area of the diffuser passage, an acceleration of the fluid flow is induced.

The present disclosure relates to a centrifugal compressor having a centrifugal acceleration stabilizer ring that reduces the effect of the recirculation flow without accelerating the fluid flow along the entirety of the diffuser passage. The centrifugal acceleration stabilizer ring is positioned at the exit of the impeller, causing an acceleration of the fluid flow in a vaneless region at the inlet of the diffuser passage. The centrifugal acceleration stabilizer ring aligns the primary and secondary flow fields, forcing the secondary flow to follow the main direction of the fluid motion (radially with respect to an axis of rotation of the centrifugal compressor).

Detailed Description of Example Embodiments

Referring generally to FIGS. 1 through 15, centrifugal compressors 100 are described in accordance with example embodiments of the present disclosure. In embodiments, a dynamic compressor can be configured as a centrifugal compressor 100 that provides a pressurized flow of fluid, as the one shown in FIGS. 3 through 6. The centrifugal compressor 100 includes an inlet 101 in fluid communication with an impeller 104. The inlet 101 supplies the fluid flow 106 to the impeller 104, which is configured to receive the fluid flow 106, accelerate the fluid flow 106 to a higher velocity, and then dispense the fluid flow 106.

The impeller 104 includes a plurality of blades 108 disposed around a hub 109 and an impeller trailing edge 113. The plurality of blades 108 is configured to rotate about an axis 110 to receive the fluid flow 106 aligned with the axis 110. The impeller 104 can be driven by a drive (not shown), such as an electric motor, an internal combustion engine, or the like, configured to provide rotational output. In the present example, the impeller 104 accelerates the fluid flow 106 to a higher velocity and then dispenses the fluid flow 106 at the high velocity in a direction at least generally perpendicular to the axis 110 (e.g., radially with respect to the axis 110). In example embodiments, the impeller 104 can be either a semi-open or semi-enclosed, impeller. Semi-open impellers have one side open, generally the inlet side, and one side enclosed, generally the hub side. Semi-open impeller may also be referred to as open-face impellers. It should be understood that a fully open impeller or a closed impeller (a shrouded impeller) may be used in different example embodiments of the centrifugal compressor 100.

Figure 2:
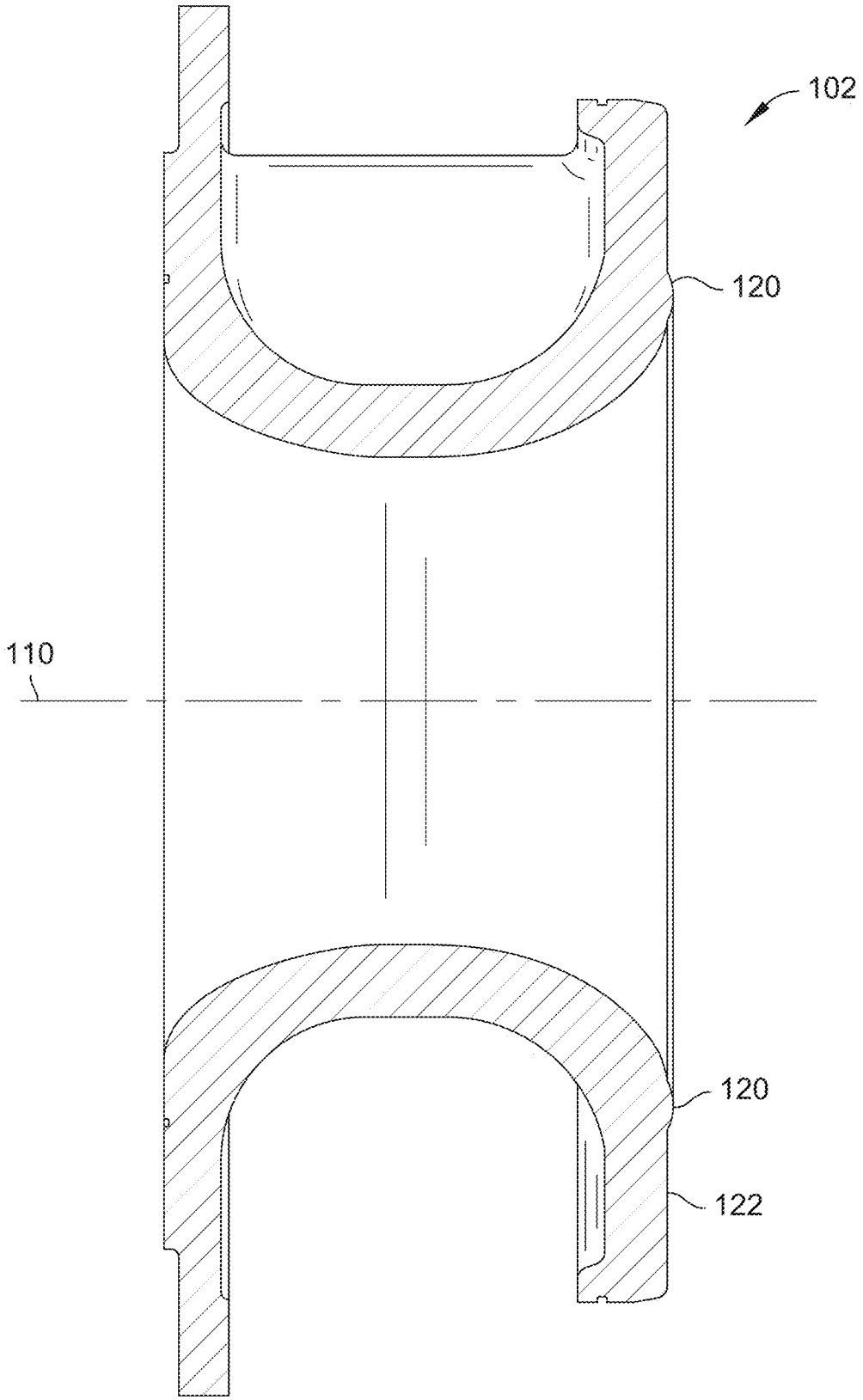
FIG. 2 is a partial cross-sectional side view of the shroud of the centrifugal compressor illustrated in FIG. 1, taken on the line 2-2 in FIG. 1 in accordance with example embodiments of the present disclosure.

According to example embodiments, the centrifugal compressor 100 includes a shroud 102, shown in FIGS. 1 and 2, configured to surround the impeller 104 and direct the fluid flow 106 exiting the impeller 104. The centrifugal compressor 100 also includes a diffuser 112 in fluid communication with the impeller 104. The diffuser 112 is circumferentially disposed around the impeller 104 opposite the shroud 102.

Figure 3:
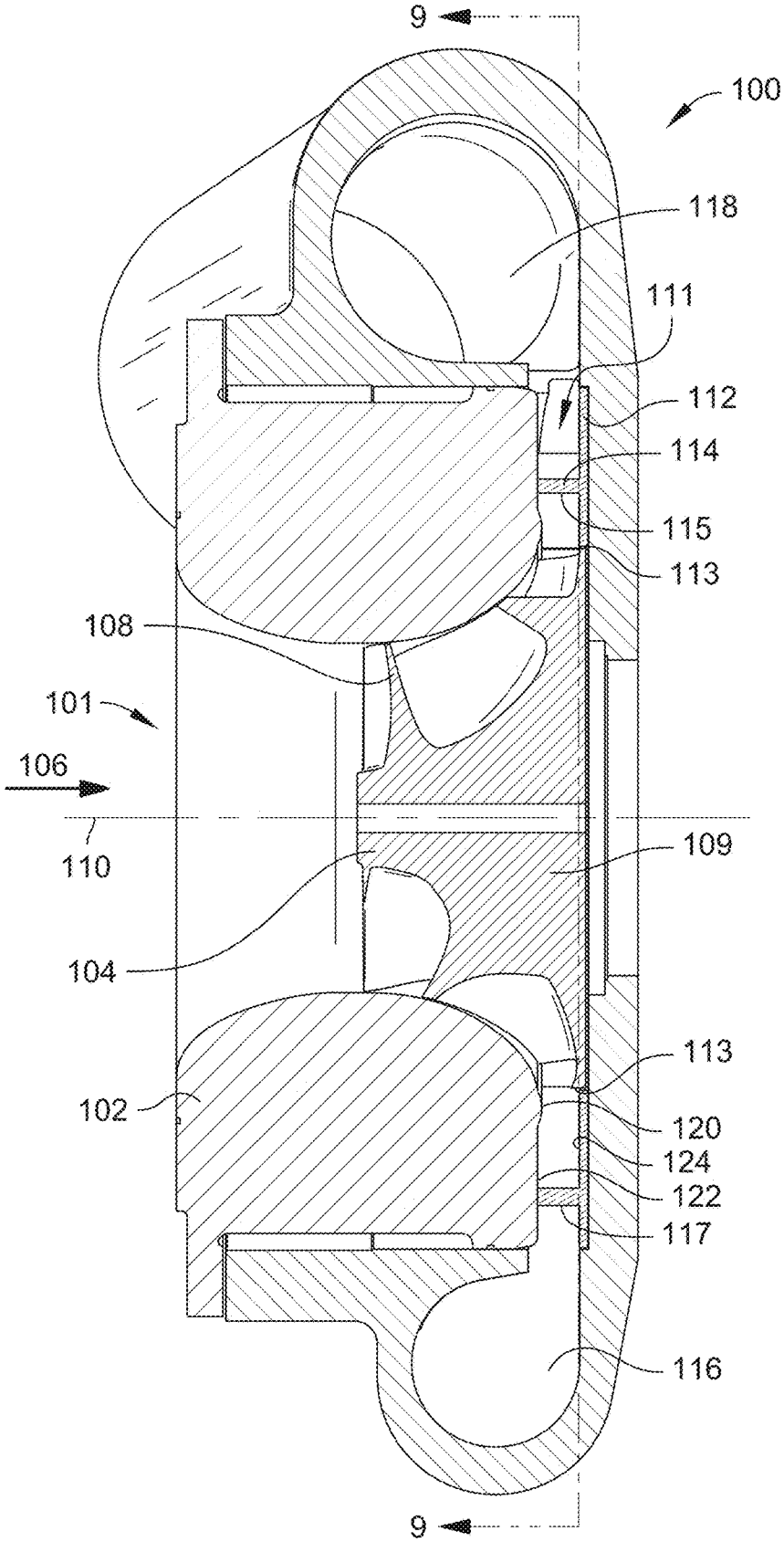
FIG. 3 is a partial cross-sectional side view illustrating a centrifugal compressor having a centrifugal acceleration stabilizer in accordance with example embodiments of the present disclosure.
Figure 4:
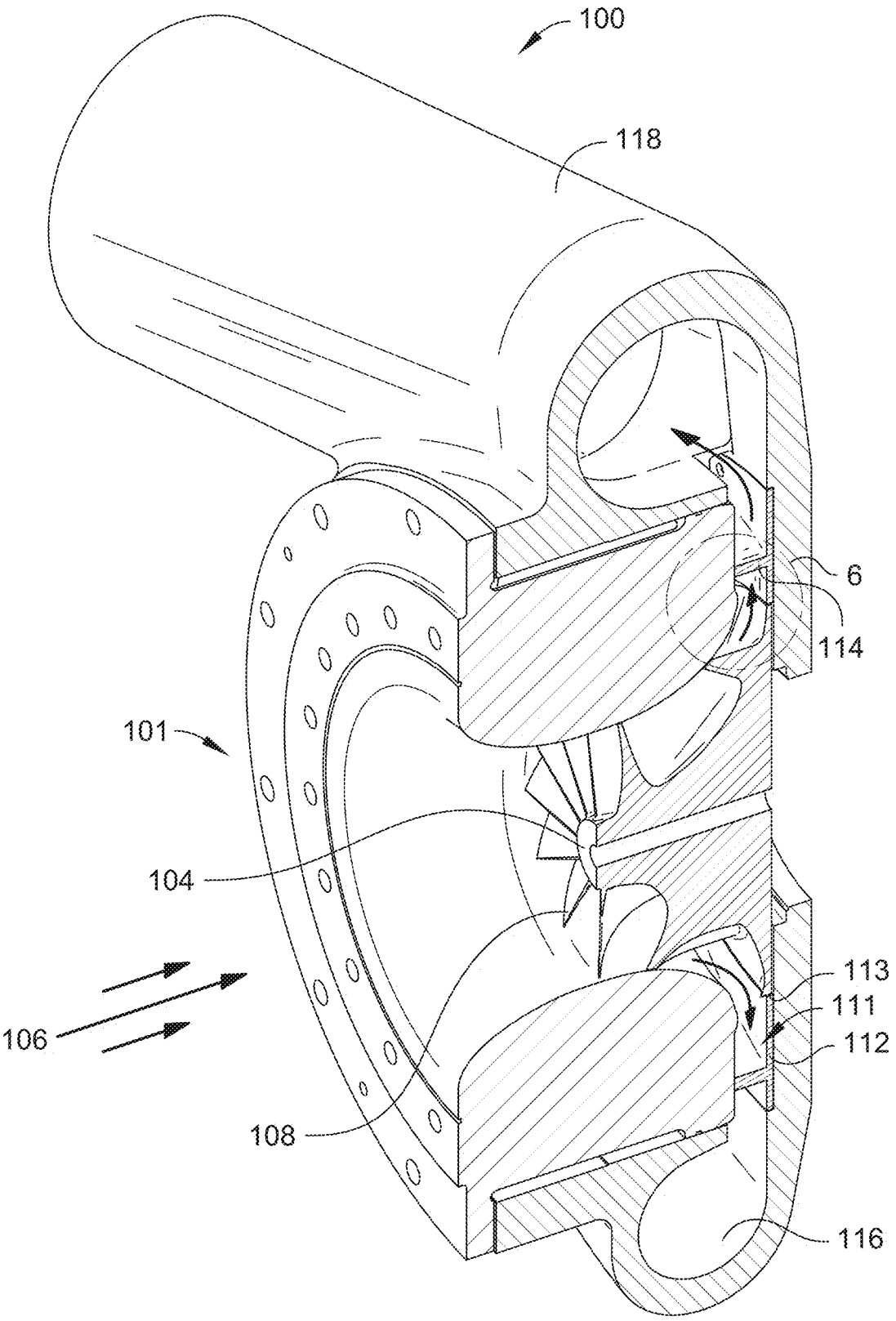
FIG. 4 is an isometric cross-sectional view illustrating a centrifugal compressor having a centrifugal acceleration stabilizer in accordance with example embodiments of the present disclosure.
Figure 5:
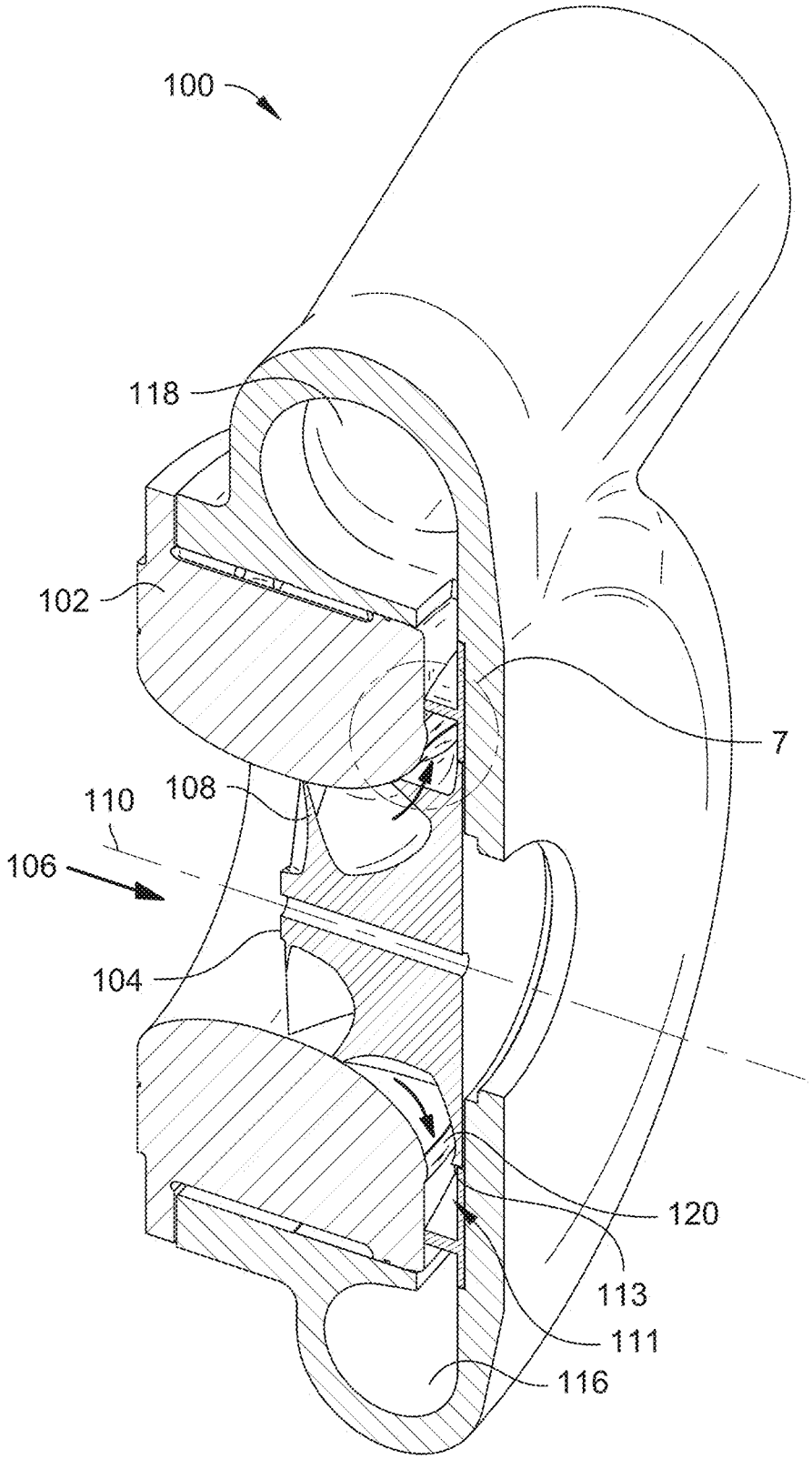
FIG. 5 is an isometric cross-sectional view illustrating a centrifugal compressor having a centrifugal acceleration stabilizer in accordance with example embodiments of the present disclosure.
Figure 9:
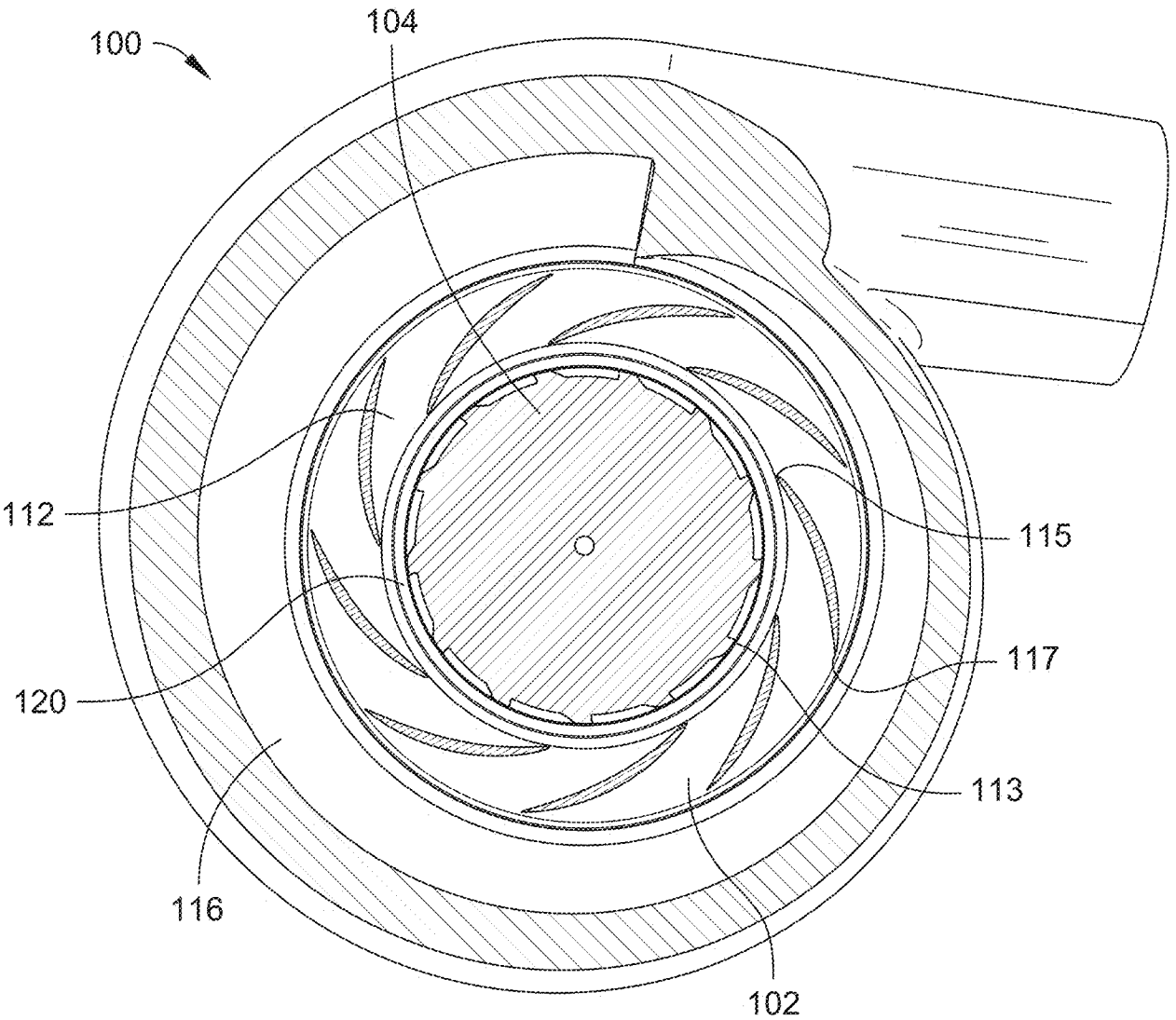
FIG. 9 is an isometric cross-sectional bottom view of the centrifugal compressor shown in FIG. 3, taken on the line 9-9, having a centrifugal acceleration stabilizer ring positioned between a trailing edge of an impeller and a leading edge of a plurality of diffuser vanes in accordance with example embodiments of the present disclosure.

Referring to FIGS. 3 through 5, the diffuser 112 includes a diffuser passage 111 defined by a shroud surface 122, adjacent to the shroud 102, and a hub surface 124, adjacent to the hub 109. The diffuser 112 is configured to receive the fluid flow 106 at a high velocity from the impeller 104 and convert the high velocity fluid flow 106 into a high pressure fluid flow 106. In this manner, the centrifugal compressor 100 produces a high pressure fluid output. In embodiments, the diffuser 112 may include a plurality of diffuser vanes (e.g., vanes and/or vanelets) 114. The plurality of diffuser vanes 114 extend from the hub surface 124 to the shroud surface 122. In example embodiments, the plurality of diffuser vanes may partially extend from the hub surface 124 to the shroud surface 122. As shown in FIG. 9, each one of the plurality of diffuser vanes 114 includes a vane leading edge 115 and a vane trailing edge 117. FIG. 9 illustrates a low solidity diffuser (LSD), wherein the diffuser vanes 114 are arranged in a single row. In other example embodiments (not shown), the diffuser 112 may have multiple rows of diffuser vanes (e.g., vanes and/or vanelets) 114, be a channel-wedge diffuser, a vaneless diffuser, or a partial vane diffuser, wherein the diffuser vanes (e.g., vanes and/or vanelets) 114 are staggered between the shroud surface 122 and the hub surface 124.

The centrifugal compressor 100 further includes a volute 116 in fluid communication with the diffuser 112. The volute 116 receives the high pressure fluid flow 106 from the diffuser 112 and discharges the high pressure fluid flow 106 from the centrifugal compressor 100. The volute 116 includes a volute discharge 118 that discharges the high pressure fluid flow 106, from where it is to be directed to its final application or to a next compressor stage (not shown).

In the example embodiments shown in FIGS. 4 and 5, the diffuser 112 is a parallel-walled diffuser, where the shroud surface 122 and the hub surface 124 are parallel to each other along the entirety of a radial length of the diffuser 112. In other embodiments (not shown), the shroud surface 122 and the hub surface 124 may be tapered to maintain a constant area or may be tapered to limit the area expansion associated with parallel wall diffusers.

Figure 10:
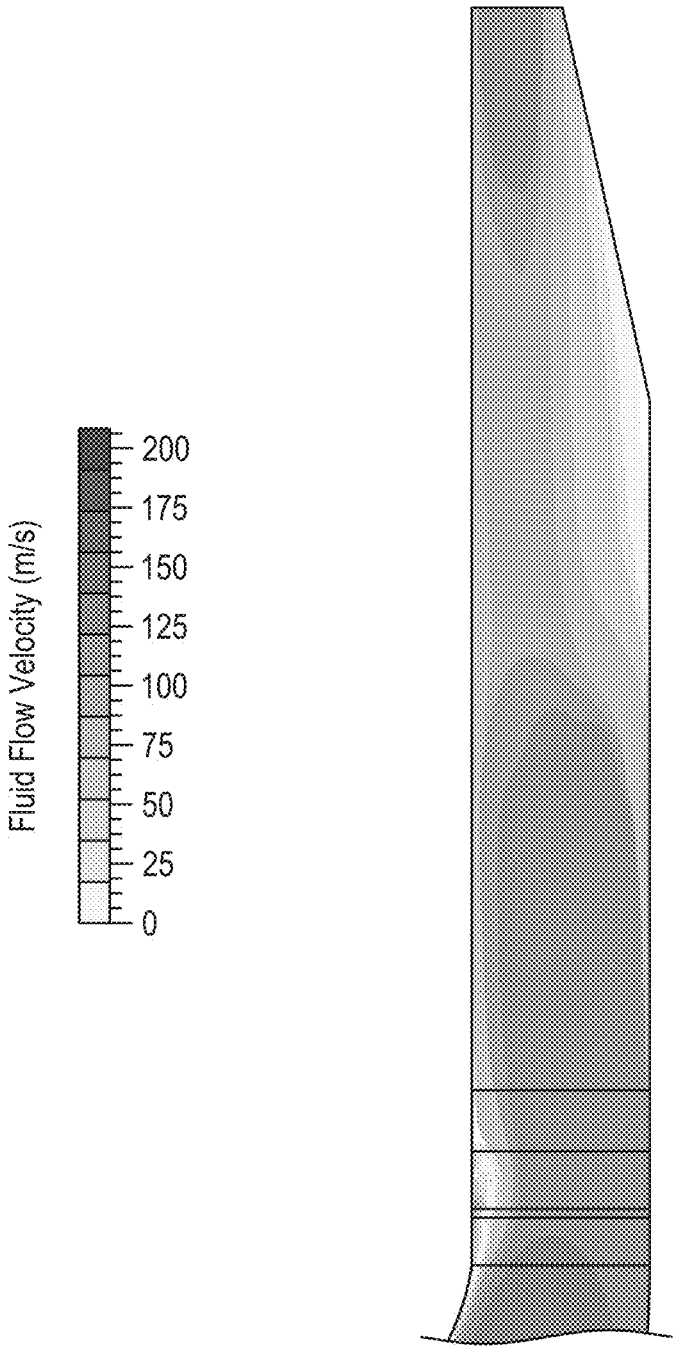
FIG. 10 is a diagrammatic illustration of the velocity inside a diffuser without a centrifugal acceleration stabilizer ring.
Figure 11:
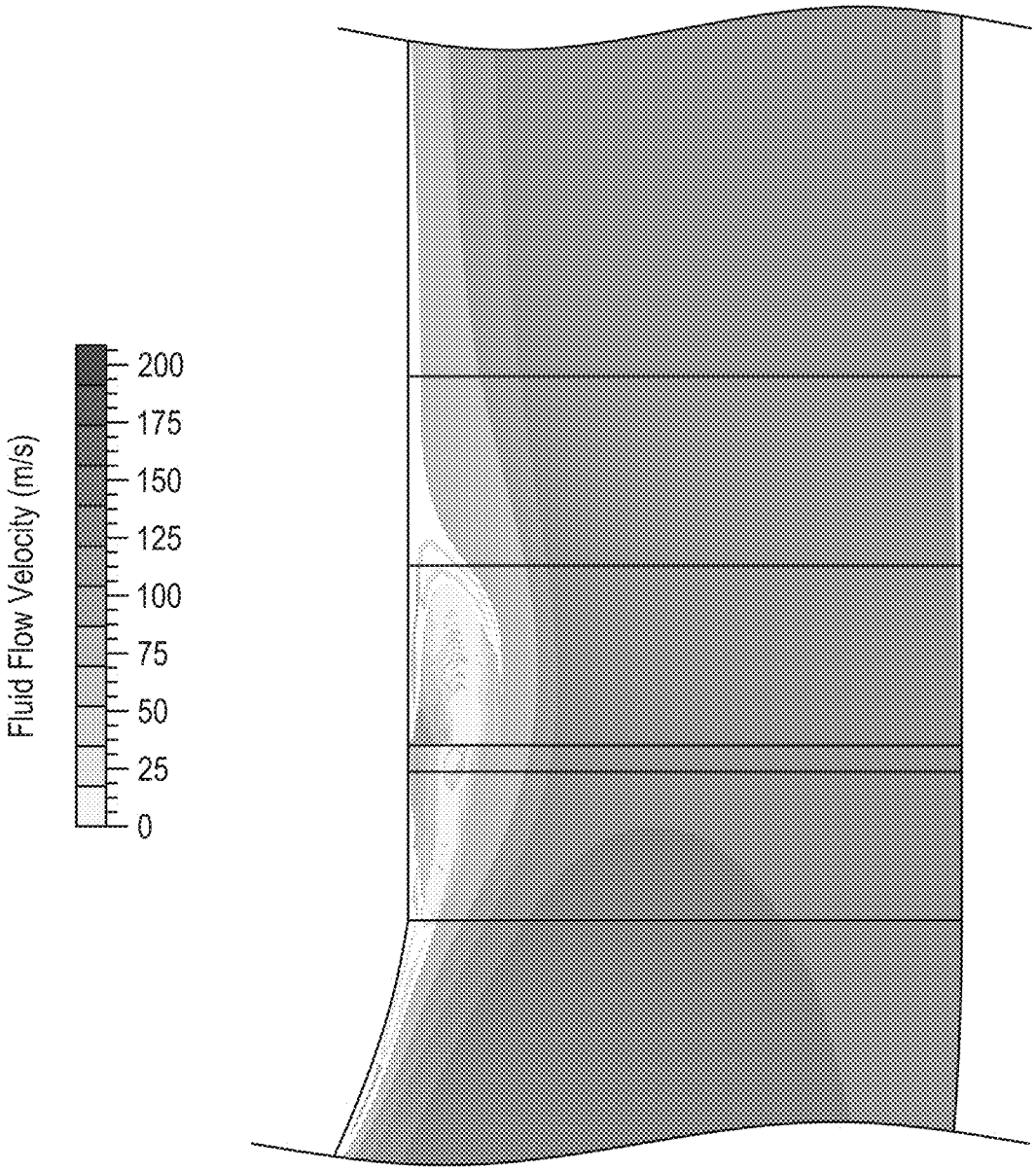
FIG. 11 is a partial diagrammatic illustration of the velocity inside the diffuser shown in FIG. 10, showing a secondary flow zone at an inlet of the diffuser.
Figure 12:
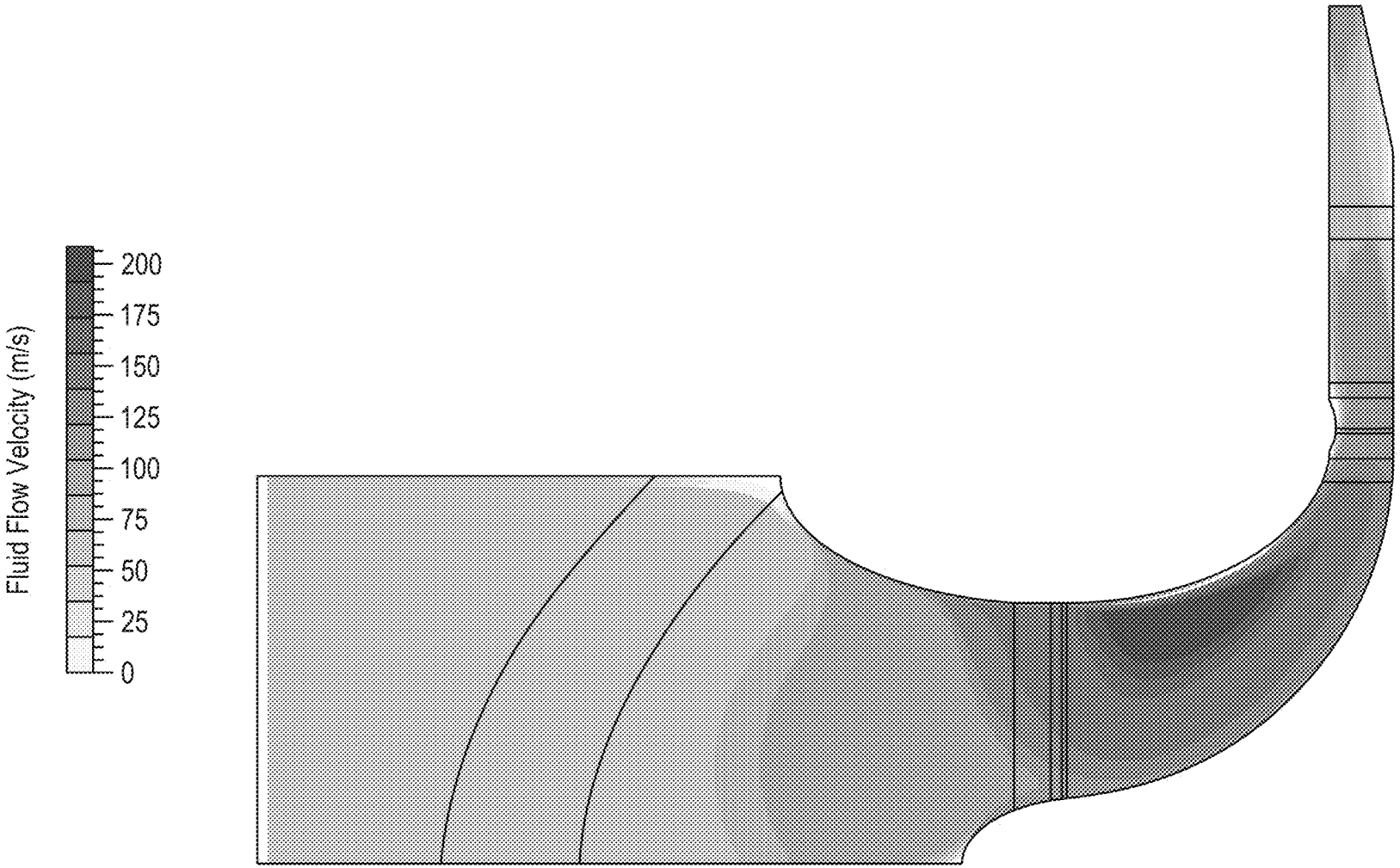
FIG. 12 is a diagrammatic illustration of the velocity inside a centrifugal compressor having a centrifugal acceleration stabilizer ring, such as the centrifugal compressor illustrated in FIG. 3, in accordance with example embodiments of the present disclosure.
Figure 13:
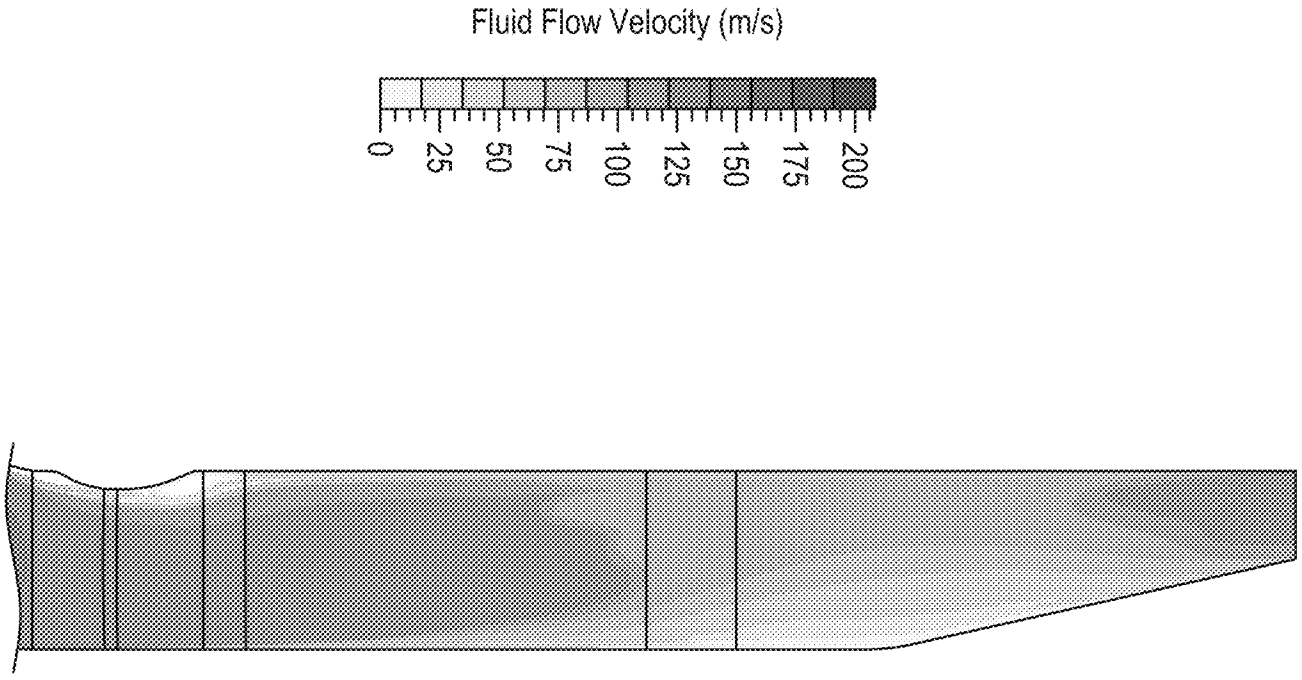
FIG. 13 is a partial diagrammatic illustration of the velocity inside a diffuser having a centrifugal acceleration stabilizer ring in accordance with example embodiments of the present disclosure.
Figure 14:
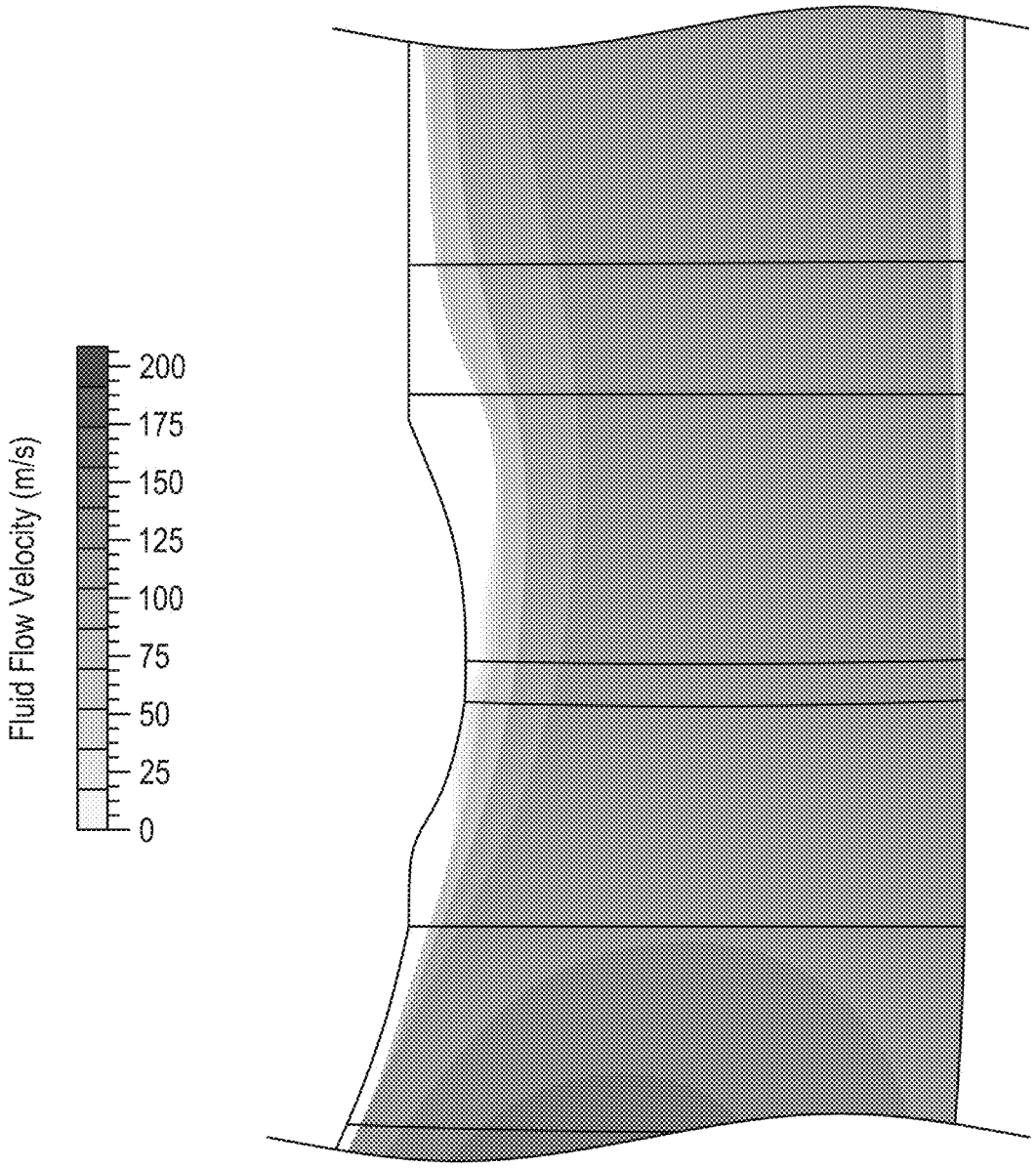
FIG. 14 is a diagrammatic illustration of the velocity inside the diffuser having a centrifugal acceleration stabilizer ring shown in FIG. 13, showing a secondary flow zone at an inlet of the diffuser in accordance with example embodiments of the present disclosure.

The diffuser passage includes a vaneless region defined between the impeller trailing edge 113 and the vane leading edge 115. Upon exiting the impeller 104, the fluid flow 106 can be considered as being comprised of two (2) flow zones: a primary isentropic core and a zone of secondary flow. The zone of secondary flow has lower radial momentum, and can generate a recirculation area adjacent to the shroud surface 122, as shown in FIGS. 10 and 11. In order to minimize a recirculation of the fluid flow 106 at the exit of the impeller trailing edge 113, a centrifugal acceleration stabilizer ring 120 is disposed at the vaneless region preceding the diffuser vanes 114 of the diffuser 112, as shown in FIG. 3. The centrifugal acceleration stabilizer ring 120 creates a short acceleration region between the exducer of the impeller and the leading edge of the diffuser by narrowing the passage of the fluid flow 106 entering the diffuser 112. The fluid flow 106 is energized and directed towards the isentropic core flow, or primary flow. Following this acceleration region, the fluid flow 106 is directed into the plurality of diffuser vanes 114 of the diffuser 112, resulting in a more stabilized (and efficient) diffusion process. The centrifugal acceleration stabilizer ring 120 configured to increase the radial velocity of a lower momentum region of a flow field flowing in the diffuser 112, resulting in a more uniform flow field across the diffuser passage 111, before re-expanding the area to facilitate diffusion before entering a vaned region having the plurality of diffuser vanes 114.

The centrifugal acceleration stabilizer ring 120 can substantially reduce the total efficiency losses associated with the recirculation of the fluid flow 106. Since the centrifugal acceleration stabilizer ring 120 pinches the diffuser passage only prior to the fluid flow 106 being diffused by the plurality of diffuser vanes 114, and the walls of the shroud surface 122 and the hub surface 124 remain at a parallel height for the remaining radial length of the diffuser passage, the diffuser 112 to maintains a high diffusion value.

In embodiments, the centrifugal acceleration stabilizer ring 120 may be machined directly into the shroud surface 122. In other example embodiments, the centrifugal acceleration stabilizer ring 120 may be permanently or removably attached to the shroud surface 122 at the vaneless region wherein the secondary flow zone develops. In yet other example embodiments, the centrifugal acceleration stabilizer ring 120 may be cast alongside the shroud 102.

Figure 6:
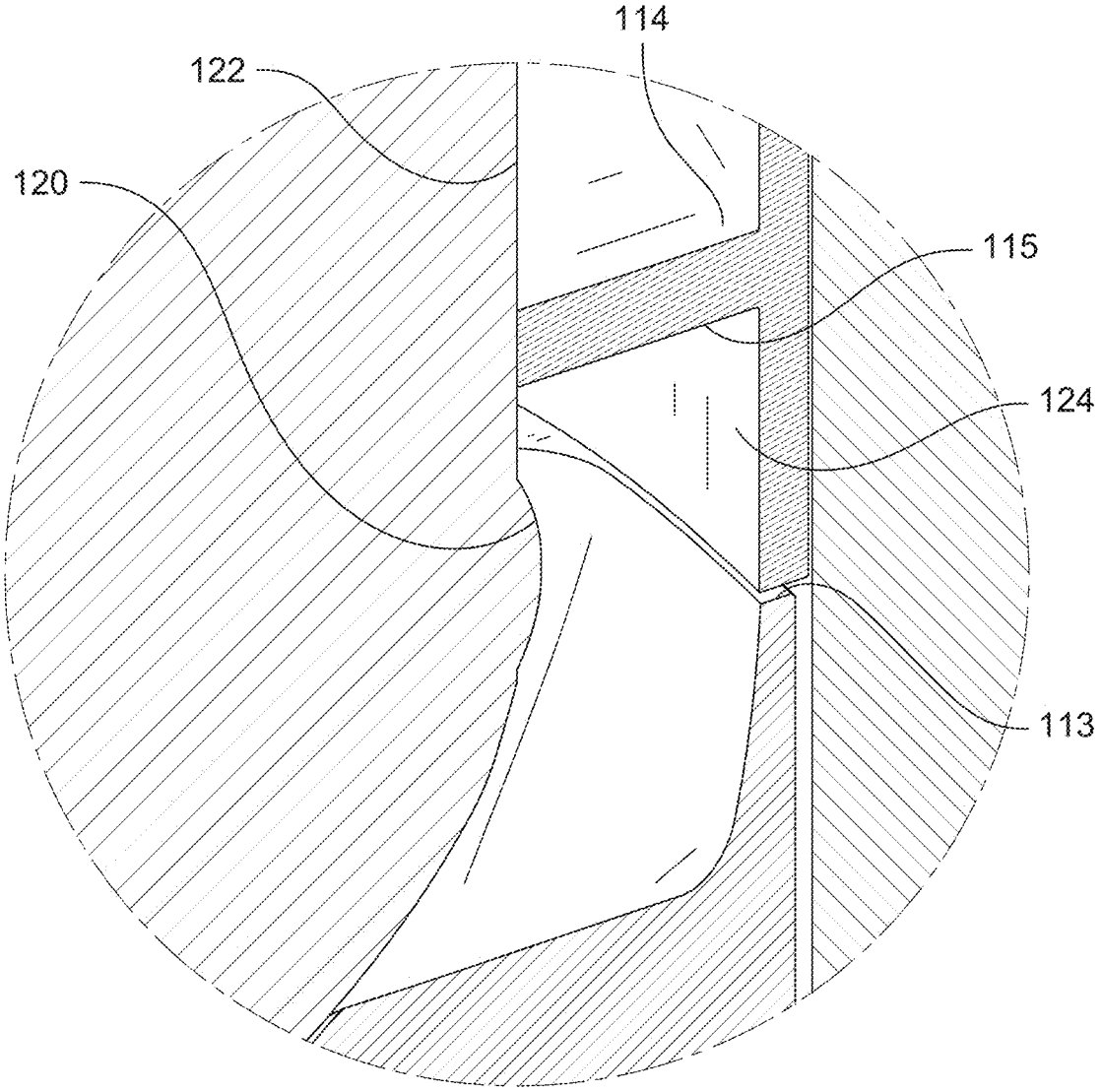
FIG. 6 is a partial isometric cross-sectional side view of the centrifugal compressor illustrated in FIG. 4, taken on the circle 6 of FIG. 4, showing a centrifugal acceleration stabilizer ring having a semi-circular profile, in accordance with example embodiments of the present disclosure.
Figure 7:
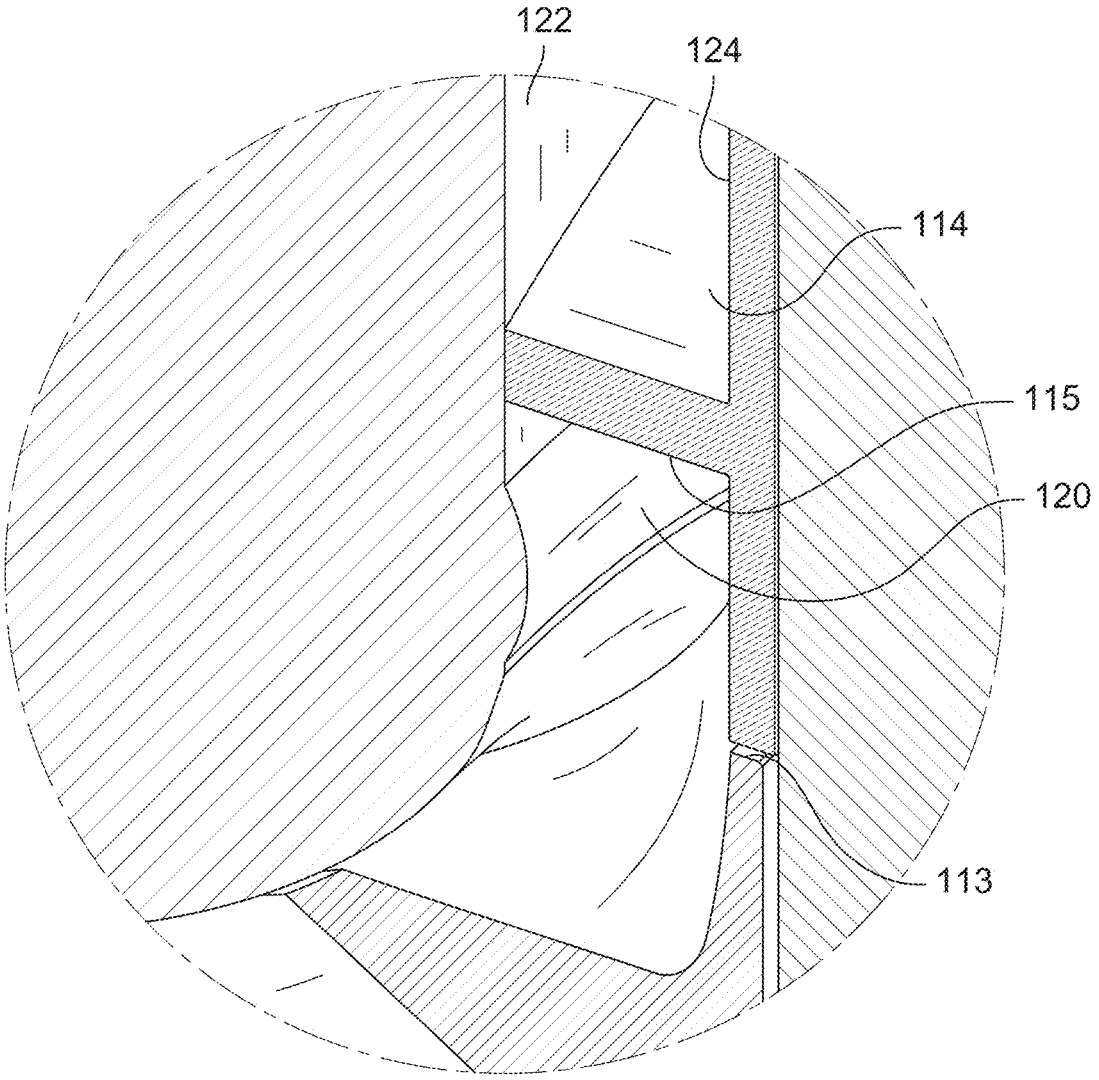
FIG. 7 is a partial isometric cross-sectional side view of the centrifugal compressor illustrated in FIG. 5, taken on the circle 7 of FIG. 5, showing a centrifugal acceleration stabilizer ring having a semi-circular profile, in accordance with example embodiments of the present disclosure.
Figure 8:
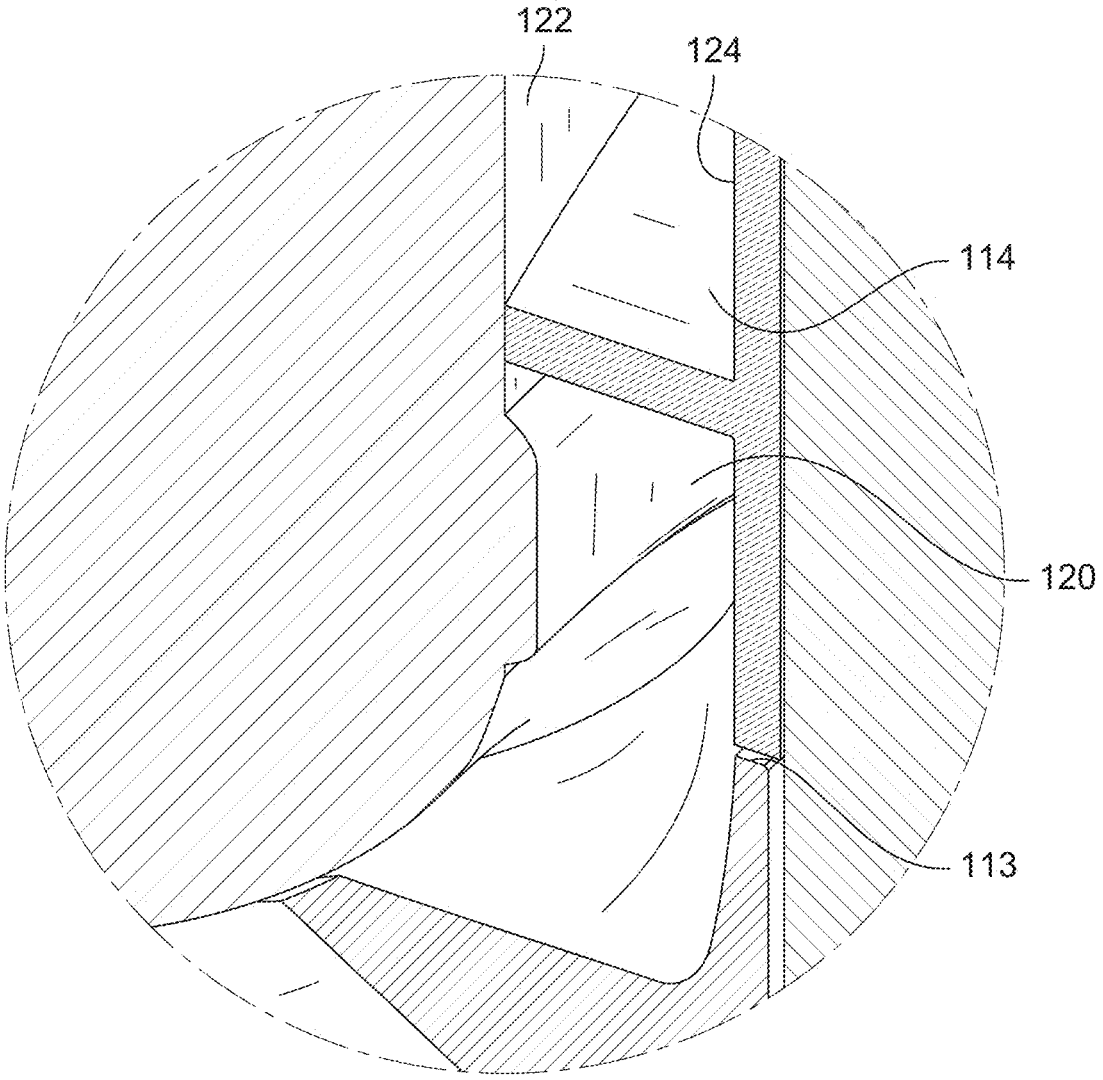
FIG. 8 is a partial isometric cross-sectional side view showing a centrifugal acceleration stabilizer ring having a curved profile and a substantially flat top surface, in accordance with example embodiments of the present disclosure.

Referring to FIGS. 6 through 8, different example embodiments of the cross-sectional profile of the centrifugal acceleration stabilizer ring 120 are shown. The cross-sectional profile of the centrifugal acceleration stabilizer ring is defined by a protrusion. In example embodiments, the centrifugal acceleration ring 120 is defined by a curved semi-circular protrusion, as shown in FIGS. 6 and 7. In another example embodiment, the cross-sectional profile of the centrifugal acceleration stabilizer ring 120 is defined by an arch-shaped protrusion having a substantially flat top surface, as shown in FIG. 8. In yet other example embodiments, the cross-sectional profile of the centrifugal acceleration stabilizer ring 120 may be defined by an airfoil, an oval or an elliptical protrusion (not shown).

In the example embodiment shown in FIG. 9, the cross-sectional profile of the centrifugal acceleration stabilizer ring 120 occupies the entirety of the radial length of the vaneless region. In different embodiments (not shown) the centrifugal acceleration stabilizer ring 120 may only cover a partial radial length of the vaneless region. The centrifugal acceleration stabilizer ring 120 may be offset from the vane leading edge 115 to prevent interference in the assembly of the centrifugal compressor 100. In example embodiments, the radial length of the vaneless region 121 extends between ten percent (10%) and twenty-five percent (25%) of the radius of impeller 104. The height of the centrifugal acceleration stabilizer ring 120 may be between three percent (3%) and twenty percent (20%) of the diffuser passage height, or the distance between the shroud surface 122 and the hub surface 124. In example embodiments, the height of the centrifugal acceleration stabilizer ring is between five percent (5%) and twenty percent (20%) of the diffuser passage height. It should be understood that both the radial length and the height of the cross-sectional profile of the centrifugal acceleration stabilizer ring 120 may be lower or higher than in the example embodiments discussed.

Referring to FIGS. 10 and 11, a computational fluid dynamics (CFD) diagram of a centrifugal compressor without a centrifugal acceleration stabilizer ring is shown. As observed, there is a zone of low radial momentum in the fluid flow at the exit of the impeller, developing a recirculation, or secondary flow, zone that causes losses in diffuser efficiency. FIGS. 12 through 15 show a CFD diagram of centrifugal compressor 100 with centrifugal acceleration stabilizer ring 120. With the centrifugal acceleration stabilizer ring 120, the secondary flow zone is reduced, and the fluid flow is stabilized faster prior to entering the plurality of diffuser vanes 114 of the diffuser 112.

Figure 15:
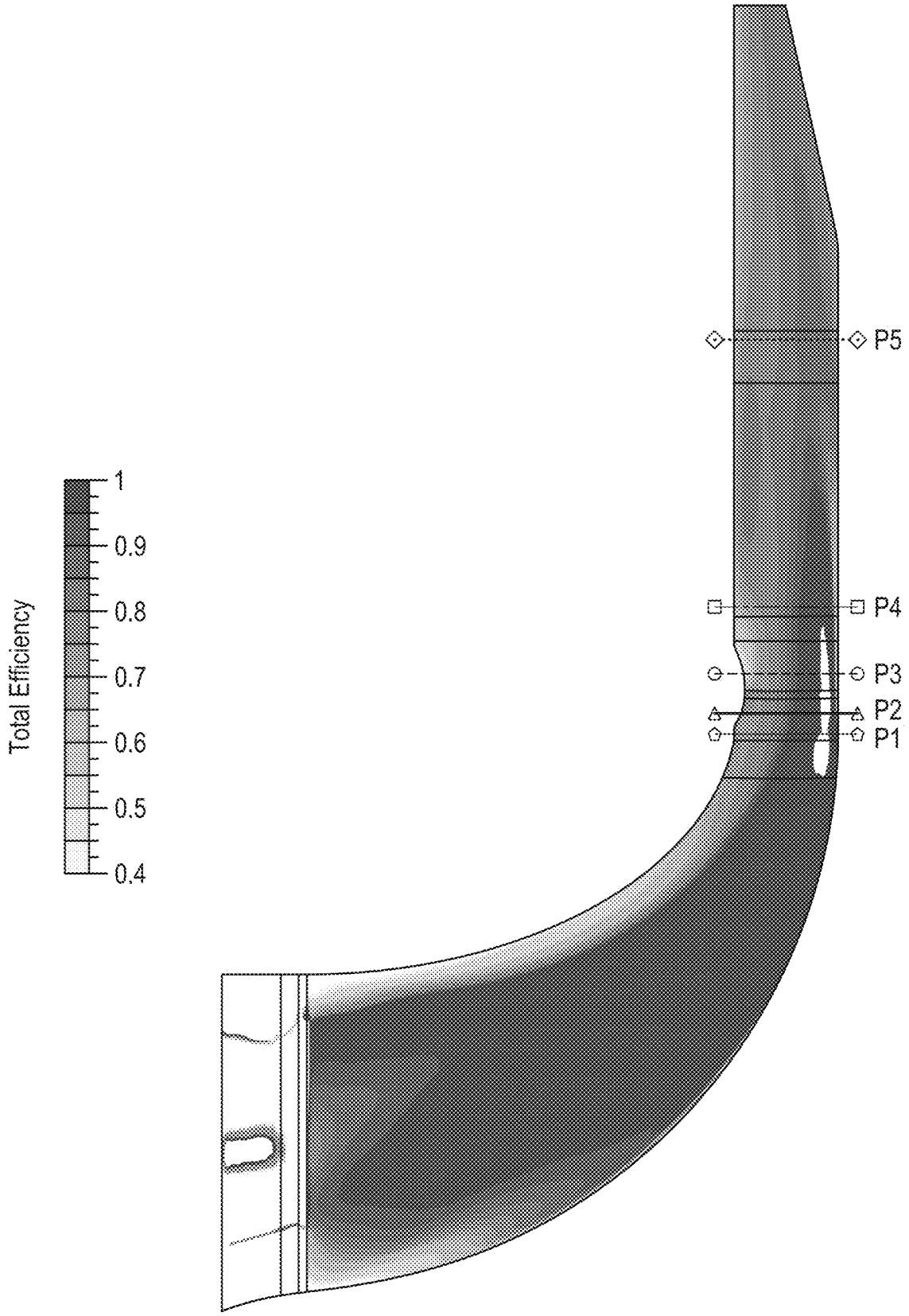
FIG. 15 is a diagrammatic illustration of a centrifugal compressor, such as the centrifugal compressor shown in FIG. 3, with test points for a computational fluid dynamics (CFD) model for evaluating the total efficiency of the centrifugal compressor at the test points in accordance with example embodiments of the present disclosure.

Referring to FIG. 15, a CFD model simulating the total efficiency of the centrifugal compressor 100 having a centrifugal acceleration stabilizer 120 is shown. FIG. 15 includes test points P1, P2, P3, P4, and P5 located at different radial lengths of the diffuser 112. P1 is located at one percent (1%) of the radial length of the diffuser from the trailing edge of the impeller, or the impeller radius. P2 is located at four percent (4%) of the radial length of the diffuser from the trailing edge of the impeller. P3 is located at ten percent (10%) of the radial length of the diffuser from the trailing edge of the impeller. P4 is located at twenty percent (20%) of the of the radial length of the diffuser from the trailing edge of the impeller. P5 is located at the exit of the diffuser 112, and prior to the entry to a collector (not shown).

Figure 16:
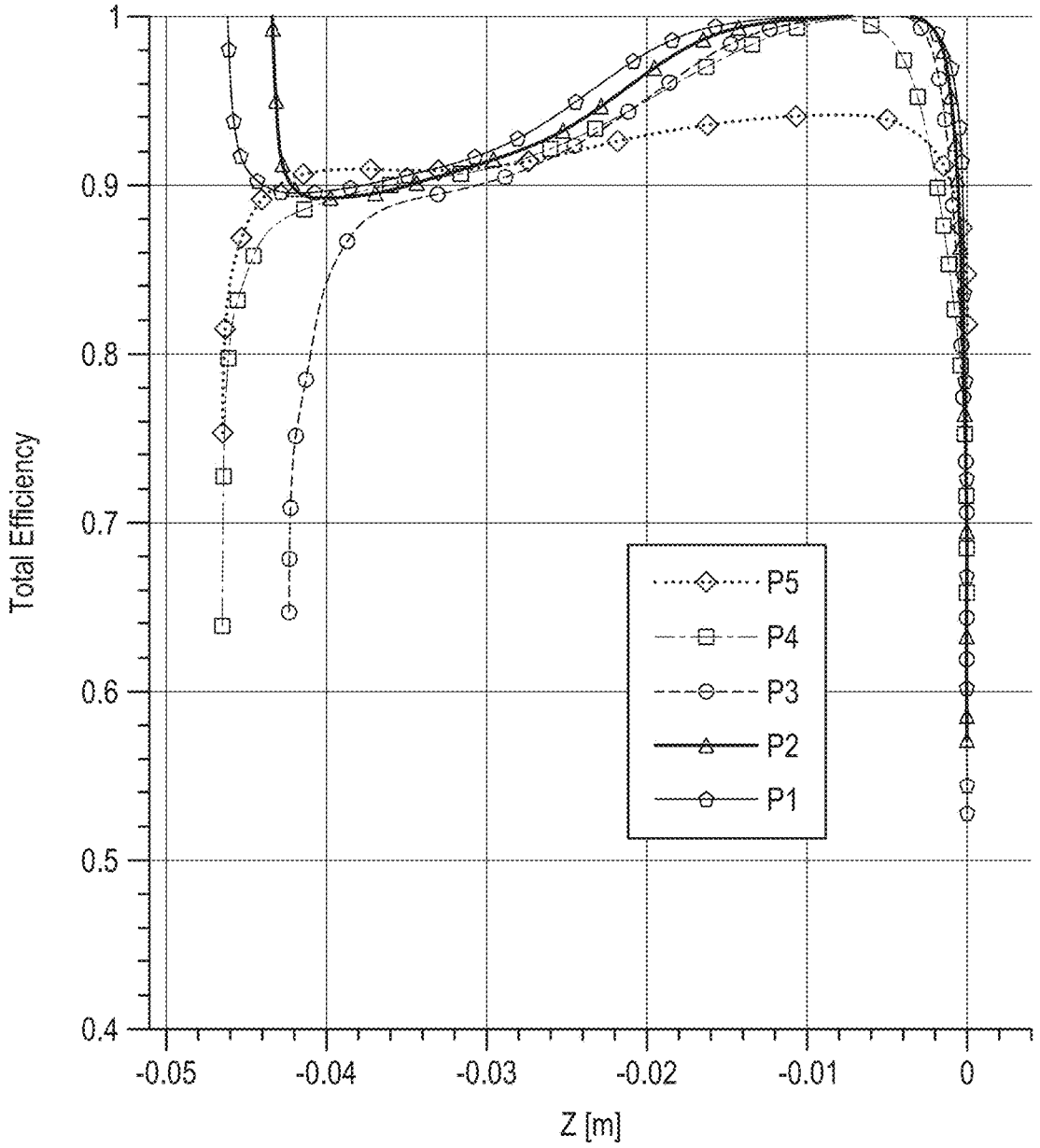
FIG. 16 is an efficiency graph illustrating the total efficiency of the CFD model of the centrifugal compressor shown in FIG. 15, taken at the test points selected in FIG. 15, in accordance with example embodiments of the present disclosure.

FIG. 16 is an efficiency graph plotting the total efficiency taken at points P1, P2, P3, P4, and P5. The x-axis represents the axial distance Z measured relative to the hub surface 124 of the diffuser passage 111, wherein the hub surface 124 (the floor of the diffuser) is at Z=0. The curves demonstrate how the efficiency changes along the axial distance Z at the different radial locations represented by the points P1, P2, P3, P4, and P5 when measuring from the hub surface 124 (the floor of the diffuser) to the shroud surface 122 (the top of the diffuser).

Figure 17:
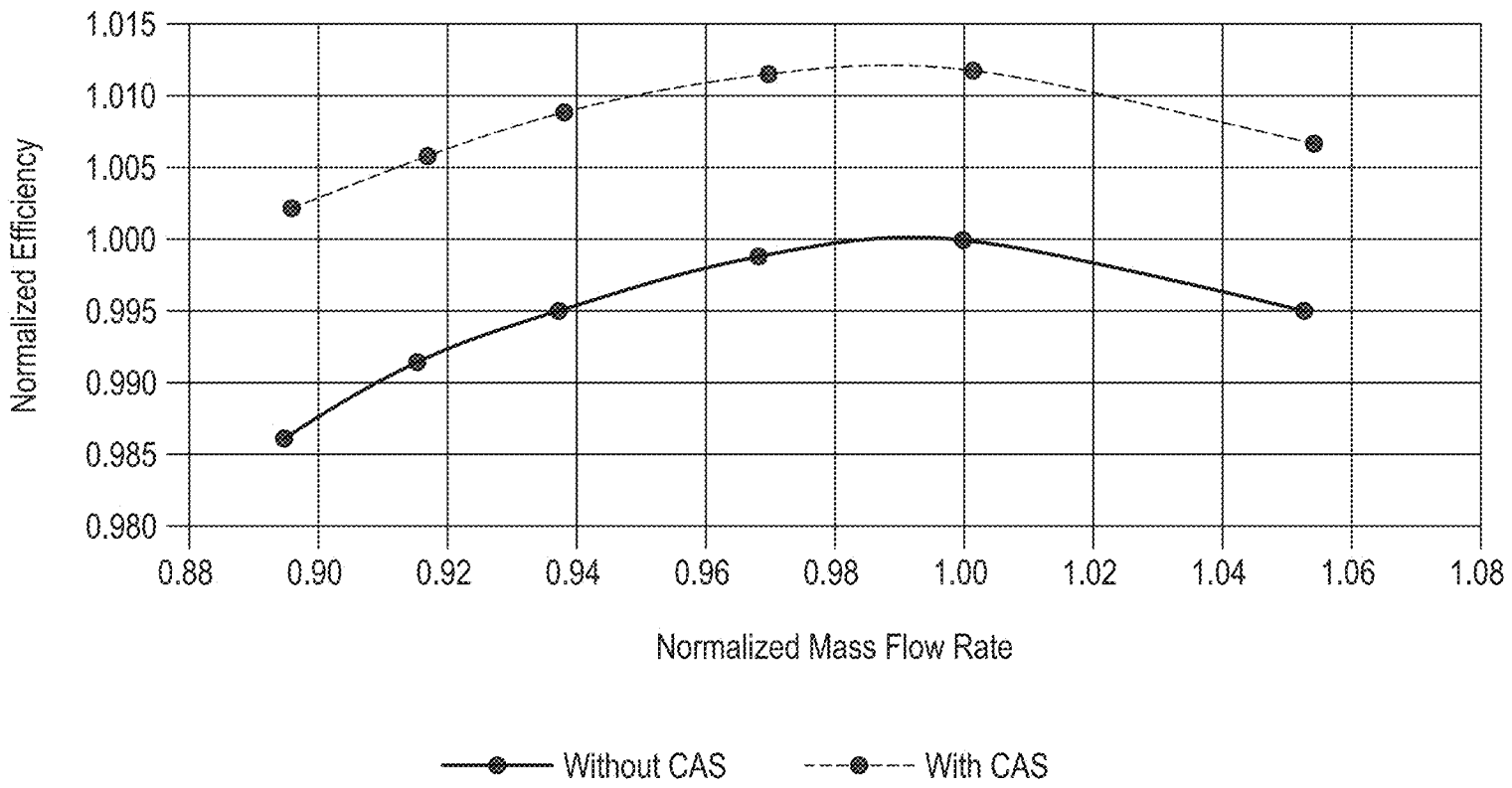
FIG. 17 is a normalized efficiency graph comparing the efficiency of a centrifugal compressor without a centrifugal acceleration stabilizer and a compressor with a centrifugal compressor stabilizer in accordance with example embodiments of the present disclosure.

Referring to FIG. 17, a normalized efficiency graph comparing the efficiency of a centrifugal compressor without a centrifugal acceleration stabilizer (CAS) ring and a compressor with a centrifugal compressor stabilizer ring is shown. The efficiency values on the y-axis are normalized to the peak efficiency value for the centrifugal compressor without the centrifugal acceleration stabilizer. The x-axis represents the mass flows that have been normalized to the design mass flow of the impeller of each centrifugal compressor.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A centrifugal compressor comprising:

an impeller having a plurality of impeller vanes disposed around a hub, the impeller configured to rotate about an axis of rotation to receive a fluid flow at least substantially aligned with the axis of rotation, accelerate the fluid flow to a high velocity fluid flow, and dispense the high velocity fluid flow in a direction at least generally perpendicular to the axis of rotation;

a shroud configured to surround the impeller and direct the high velocity fluid flow dispensed by the impeller; and a diffuser having a shroud surface adjacent to the shroud and a hub surface adjacent to the hub, the diffuser circumferentially disposed around the impeller and configured to receive the high velocity fluid flow from the impeller and convert the high velocity fluid flow into a high pressure fluid flow, the diffuser defining a diffuser passage and comprising a plurality of diffuser vanes extending from the hub surface to the shroud surface, respective ones of the plurality of diffuser vanes having a vane leading edge and a vane trailing edge;

wherein the diffuser includes a centrifugal acceleration stabilizer ring disposed in the shroud surface and located in a vaneless region between an impeller trailing edge and the vane leading edge, the centrifugal acceleration stabilizer ring configured to increase the radial velocity of a lower momentum region of a flow field flowing in the diffuser, resulting in a more uniform flow field across the diffuser passage, before re-expanding the area of the diffuser passage to facilitate diffusion before the vane leading edge, and where the centrifugal acceleration stabilizer ring has a height within a range between three percent (3%) and twenty percent (20%) of a distance between the shroud surface and the hub surface.

2. The centrifugal compressor of claim 1, wherein the vaneless region has a radial length within a range between ten percent (10%) and twenty-five percent (25%) of an impeller radius.

3. The centrifugal compressor of claim 2, wherein the centrifugal acceleration stabilizer ring extends along the entirety of the vaneless region.

4. The centrifugal compressor of claim 1, wherein a cross-sectional profile of the centrifugal acceleration stabilizer ring is defined by a curved protrusion.

5. The centrifugal compressor of claim 4, wherein the cross-sectional profile of the centrifugal acceleration stabilizer ring is defined by a semi-circular protrusion.

6. The centrifugal compressor of claim 4, wherein the cross-sectional profile of the centrifugal acceleration stabilizer ring is defined by a curved protrusion having a substantially flat top surface.

7. The centrifugal compressor of claim 1, wherein the impeller is one of a semi-open impeller or a closed impeller.

8. The centrifugal compressor of claim 1, wherein the diffuser is a parallel-wall diffuser.

9. A centrifugal compressor comprising:

an impeller having a plurality of impeller vanes disposed around a hub and an impeller trailing edge, the impeller configured to rotate about an axis of rotation to receive a fluid flow at least substantially aligned with the axis of rotation, accelerate the fluid flow to a high velocity fluid flow, and dispense the high velocity fluid flow in a direction at least generally perpendicular to the axis of rotation;

a shroud configured to surround the impeller and direct the high velocity fluid flow dispensed by the impeller; and a parallel-walled diffuser having a shroud surface adjacent to the shroud and a hub surface adjacent to the hub, the parallel-walled diffuser circumferentially disposed around the impeller and configured to receive the high velocity fluid flow from the impeller and convert the high velocity fluid flow into a high pressure fluid flow, the parallel-walled diffuser defining a diffuser passage and comprising a plurality of diffuser vanes extending substantially from the hub surface to the shroud surface, respective ones of the plurality of diffuser vanes each having a vane leading edge and a vane trailing edge;

wherein the parallel-walled diffuser includes a centrifugal acceleration stabilizer ring formed in the shroud surface in a vaneless region between the impeller trailing edge and the vane leading edge, the centrifugal acceleration stabilizer ring configured to increase the radial velocity of a lower momentum region of a flow field flowing in the diffuser, resulting in a more uniform flow field across the diffuser passage, before re-expanding the area of the diffuser passage to facilitate diffusion before the vane leading edge, and where the centrifugal acceleration stabilizer ring has a height within a range between three percent (3%) and twenty percent (20%) of a distance between the shroud surface and the hub surface.

10. The centrifugal compressor of claim 9, wherein the vaneless region has a radial length within a range between ten percent (10%) and twenty-five percent (25%) of an impeller radius.

11. The centrifugal compressor of claim 9, wherein the centrifugal acceleration stabilizer ring extends along the entirety of the vaneless region.

12. The centrifugal compressor of claim 9, wherein a cross-sectional profile of the centrifugal acceleration stabilizer ring is defined by a curved protrusion.

13. The centrifugal compressor of claim 9, wherein the impeller is one of a semi-open impeller or a closed impeller.

14. The centrifugal compressor of claim 9, wherein the centrifugal acceleration stabilizer ring extends over a partial radial length of the vaneless region.

15. The centrifugal compressor of claim 1, wherein the centrifugal acceleration stabilizer ring extends over a partial radial length of the vaneless region.

16. A centrifugal compressor comprising:

an impeller configured to rotate about an axis of rotation to receive a fluid flow at least substantially aligned with the axis of rotation, accelerate the fluid flow to a high velocity fluid flow, and dispense the high velocity fluid flow in a direction at least generally perpendicular to the axis of rotation;

a shroud configured to surround the impeller and direct the high velocity fluid flow dispensed by the impeller; and a diffuser having a shroud surface adjacent to the shroud and a hub surface adjacent to the hub, the diffuser circumferentially disposed around the impeller and configured to receive the high velocity fluid flow from the impeller and convert the high velocity fluid flow into a high pressure fluid flow, the diffuser defining a diffuser passage and comprising a plurality of diffuser vanes, respective ones of the plurality of diffuser vanes having a vane leading edge and a vane trailing edge;

wherein the diffuser includes a centrifugal acceleration stabilizer ring disposed in the shroud surface and located in a vaneless region between an impeller trailing edge and the vane leading edge, the centrifugal acceleration stabilizer ring configured to increase the radial velocity of a lower momentum region of a flow field flowing in the diffuser, resulting in a more uniform flow field across the diffuser passage, before re-expanding the area of the diffuser passage to facilitate diffusion before the vane leading edge, and where the centrifugal acceleration stabilizer ring has a height within a range between three percent (3%) and twenty percent (20%) of a distance between the shroud surface and the hub surface.

17. The centrifugal compressor of claim 16, wherein the vaneless region has a radial length within a range between ten percent (10%) and twenty-five percent (25%) of an impeller radius.

* * * * *